US006019704A

United States Patent [19]

Morgan

[11] Patent Number: 6,019,704

[45] Date of Patent: Feb. 1, 2000

[54] EXERCISE MACHINE TO EXERCISE THE WRIST AND FOREARM MUSCLES

[75] Inventor: Mark Anderson Morgan, Daphne, Ala.

[73] Assignee: Mark A. Morgan, Daphne, Ala.

[21] Appl. No.: 09/347,550

[22] Filed: Jul. 6, 1999

Related U.S. Application Data

[63] Continuation-in-part of application No. 09/104,127, Jul. 27, 1998.

[51] Int. Cl.[7] ..... A63B 23/14

[52] U.S. Cl. ..... 482/46; 482/99

[58] Field of Search ..... 482/44–46, 93, 482/94, 99, 100, 102, 103, 112, 113, 120, 130, 139

[56] References Cited

U.S. PATENT DOCUMENTS 1,646,818 10/1927 Holland ..... 482/99

FOREIGN PATENT DOCUMENTS 611 623 6/1978 U.S.S.R. ..... 482/102

*Primary Examiner*—John Mulcahy

[57] ABSTRACT

An exercise machine for wrist and forearm development includes a rod that is rotatable about its long axis and a cable having one end attached to the rod and the other end attached to a vertically guided weight stack. When the rod is rotated, the cable is wound upon it, against the pull of the resistance. The rod is attached to a stationary frame by a pair of parallel arms, one at each end of the rod. The arms are pivotally attached to the frame on a common axis. The height of the rod is adjusted by fixing the arms in a selected angular position about the common axis. A pulley is attached to the frame for rotation about the common axis. An intermediate portion of the cable passes over the pulley. Thus, adjustment of the height of the rod does not leave any slack in the cable.

20 Claims, 6 Drawing Sheets

Front View

Side View

FIG 3 REAR VIEW

Adjustment Arm, Rotating Rod,& Bearing Assembly

Butterfly, Rotating Rod, & Cable Assembly

EXERCISE MACHINE TO EXERCISE THE WRIST AND FOREARM MUSCLES

CROSS-REFERENCE TO RELATED APPLICATIONS

This is a continuation-in-part of application Ser. No. 09/104,127 Filing Date: Jul. 27, 1998 for: An exercise machine to exercise the wrist and forearm muscles.

BACKGROUND OF THE INVENTION

This invention relates to the field of exercise/weight lifting equipment. In particular the exercise of the wrist and forearm.

Since at least the 1960's, the preferred method of exercising the forearms have been to take a length of small rope, a short piece of broomstick, and a weight. Drill a hole through the broomstick, run one end of the rope through the broomstick and tie it off. Tie the weight on the other end of the rope. Then extending the arms out in front of the body from the shoulders, rotate the broomstick either forward or reverse, either underhand, or overhand, interchanging hands as you roll the weight in a vertical movement, and reversing the procedure to lower the weight. This process exercises the wrist and forearm muscles, but does not put undue stress to the shoulders and other muscles.

Examples are: Pat. No. Des 264,237 issued to McCaleb, May 4, 1982, Pat. No. 4,072,308 issued to Applegate Feb. 7, 1978, Pat. No. 4,438,920 issued to Veillette Mar. 27, 1984, Pat. No. 4,645,203 issued to Moss Feb. 24, 1987, Pat. No. 5,547,441 issued to Mora Aug. 20, 1996. All of these patents utilize the method of rolling an object in one direction to lift a weight and reversing the procedure to lower the weight. All of these patents are considered portable and may easily be carried from one location to another by a human being without any assistance. Pat. No. 4,902,006 issued to Stallings Jr. Feb. 20, 1990 uses the same principle with horizontally adjustable handgrips and a series of pulleys and cables mounted on a frame. The rotating rod is mounted to the frame and does not have a vertical adjustment. The patent issued to McCaleb is supported by the human body, with the height of the rotating rod determined by the position and the height of the user arms. The same would apply to the patents issued to Veillette and Mora. The patent issued to Moss and Applegate have a device that allows them to be hooked over or attached to a door or other object via cords or cables.

The purpose of this invention is to provide a frame mounted mechanism that will allow a vertical height adjustment of the rotating rod that will not stress muscles that are not intended to be exercised. The rotating rod and supporting adjustment arms accomplish this purpose. The height adjustment will accomodate situations from people confined to wheelchairs, to basketball players and all in between.

SUMMARY OF INVENTION

A forearm exercising machine comprised of a vertical frame, two elongated adjustable arms with a rod mounted horizontally through each of them towards one end that is attached to each vertical member of the frame. A pulley is attached to the center of the rod. A rotating rod is mounted in bearings toward the opposite ends of the arms. In the center of the rotating arm is mounted a butterfly spool. A cable is attached to the center of the butterfly. The cable is connected to a lift eye, which is connected to a pin rod that runs through the center of the weight stack. The pin rod has horizontal holes drilled to line up with horizontal holes drilled in each weight in the weight stack. This will allow the insertion of a pin through the weight into, and through the pin rod, thereby; allowing the user to choose the amount of weight to exercise with. To utilize the machine, the user would set the adjustable arms to the desired height, and lock in place by inserting a removable pin through the adjustment holes in the arms to either one of the adjustment holes in the radius plates, of which one of each are welded to each side of the vertical frame to the inner surface. By grasping the rotating rod with the left hand, left of the butterfly, and the right hand, right of the butterfly, then by rotating the rotation rod either forward or reverse will cause the cable to wrap around the butterfly spool, raising the desired amount of weight to the desired height. To lower the weight, one would reverse this procedure, thereby; exercising both sets of wrist and forearm muscles.

DETAILED DESCRIPTION OF THE INVENTION

Figure 1:
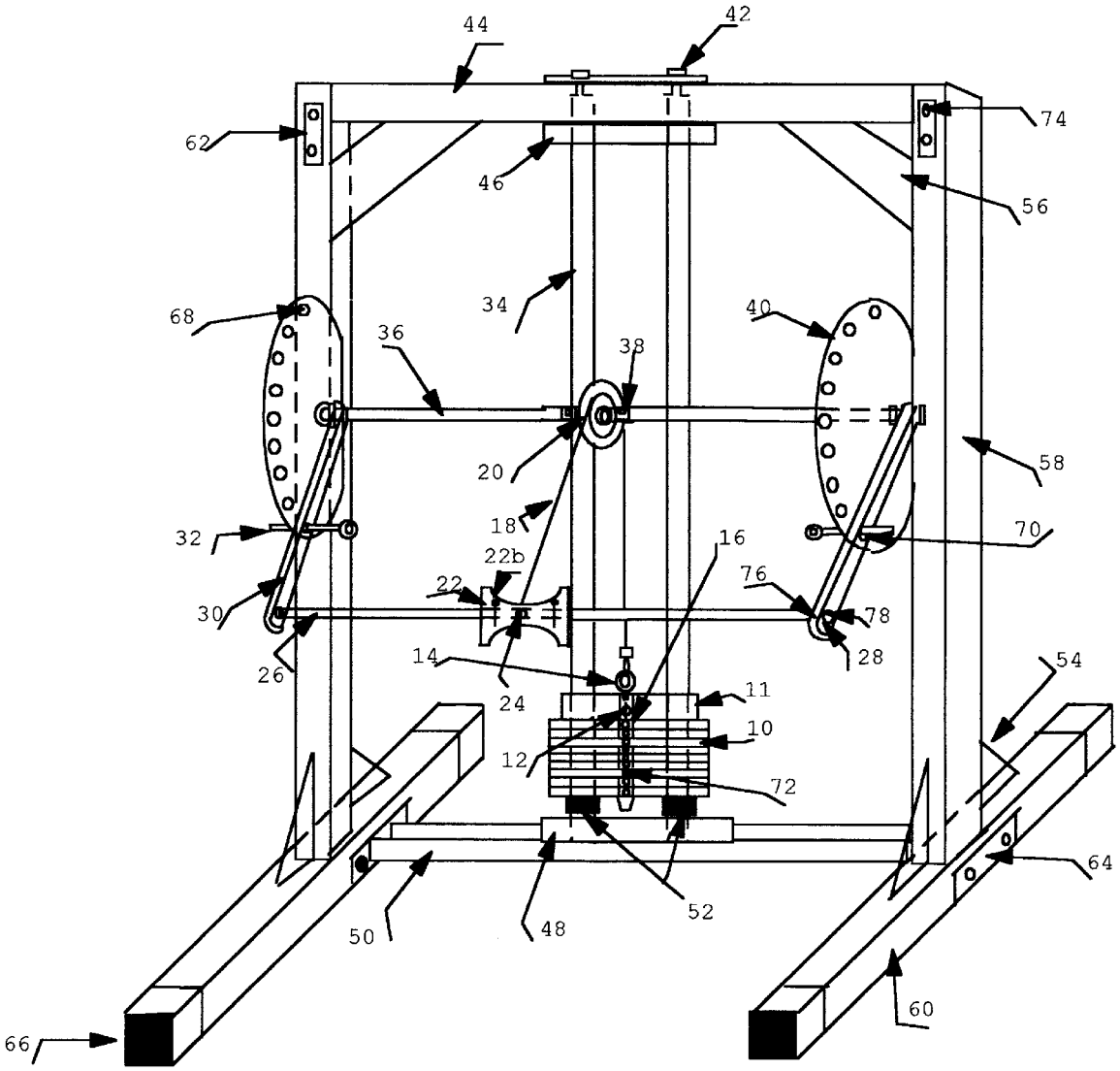
FIG. 1 is a perspective view of an exercise device embodying the principles of the present invention.
Figure 2:
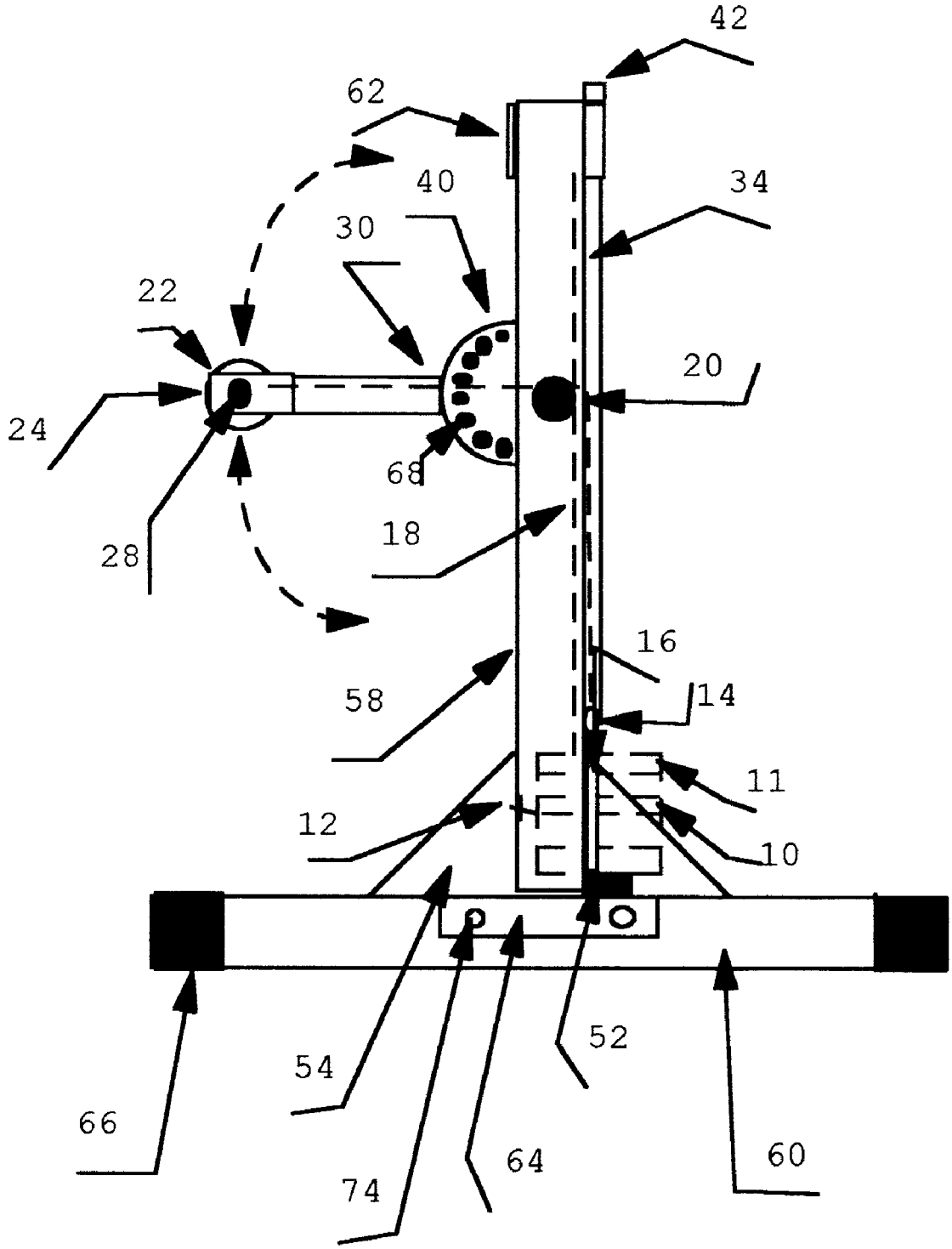
FIG. 2 is a side view of the device in FIG. 1; it shows how the height adjustment can be raised and lowered and locked in place with the height adjustment pins.
Figure 3:
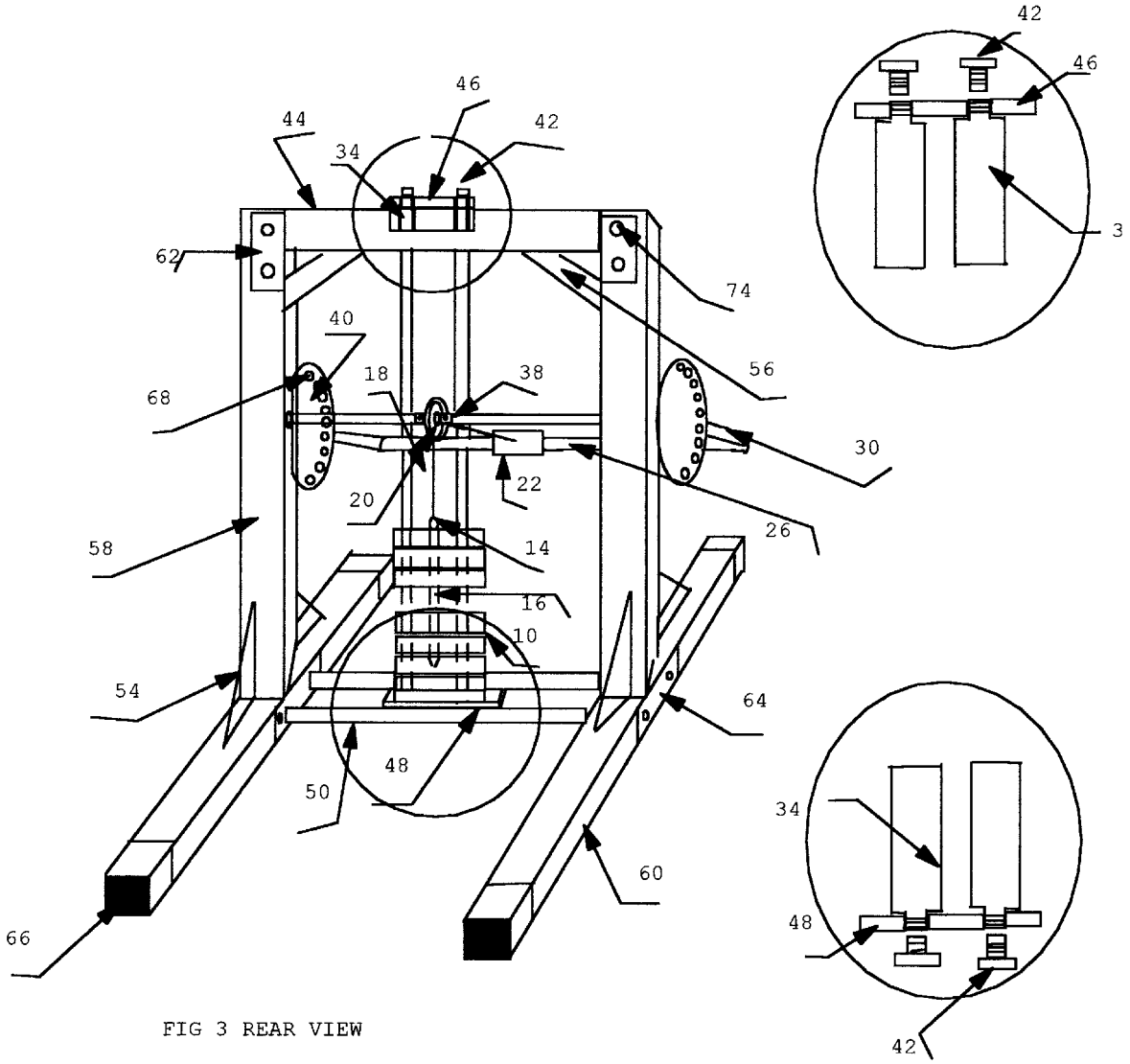
FIG. 3 is a rear independent view showing the guide bars mounted into the upper mounting plate. And the lower end of the guide bares mounted into the lower mounting plate.
Figure 4:
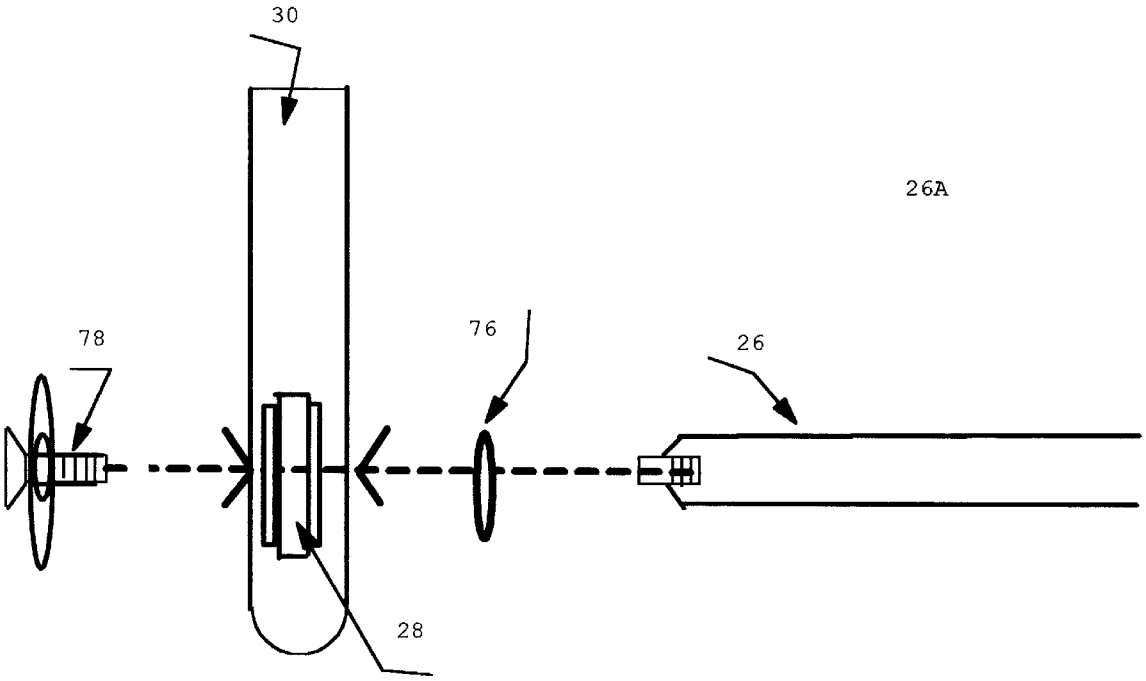
FIG. 4 is an independent view of the relationship of the adjustment arm, rotating rod, and bearing assembly.
Figure 5:
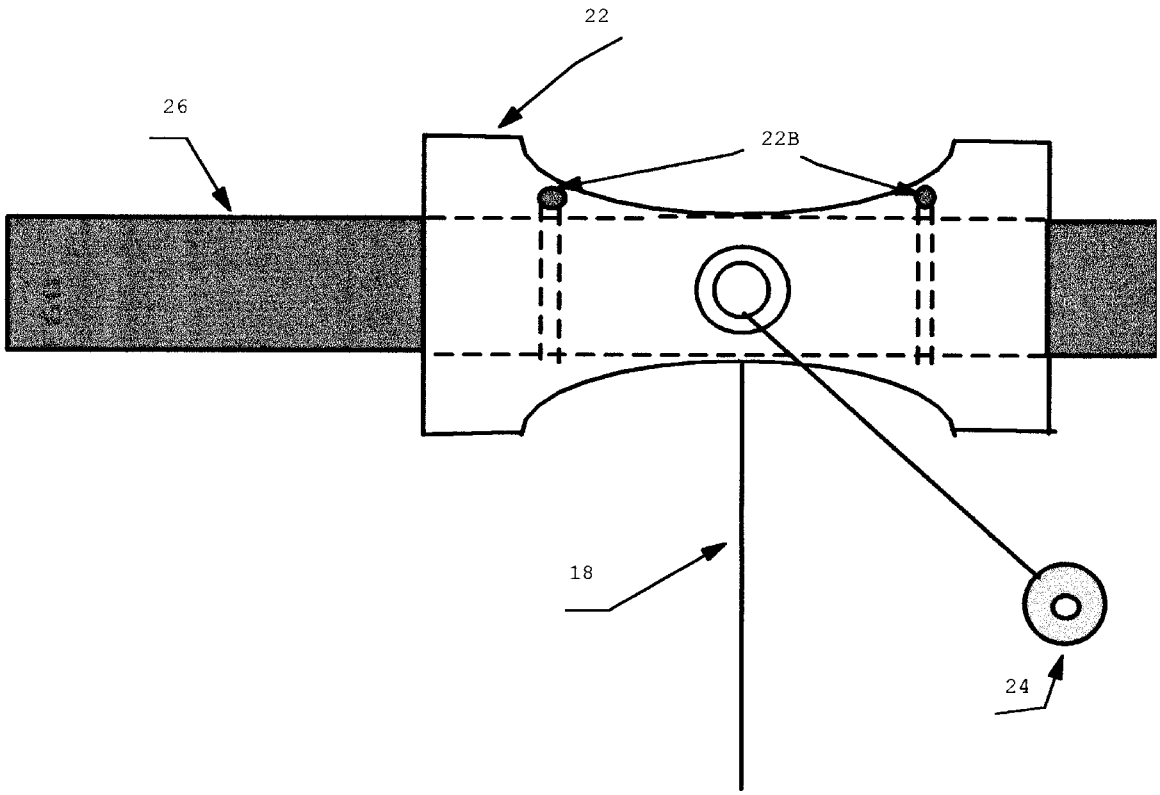
FIG. 5 is an independent view of the butterfly, mounted onto the rotating rod via roll pins, and the tension cap attachment to the cable.
Figure 6:
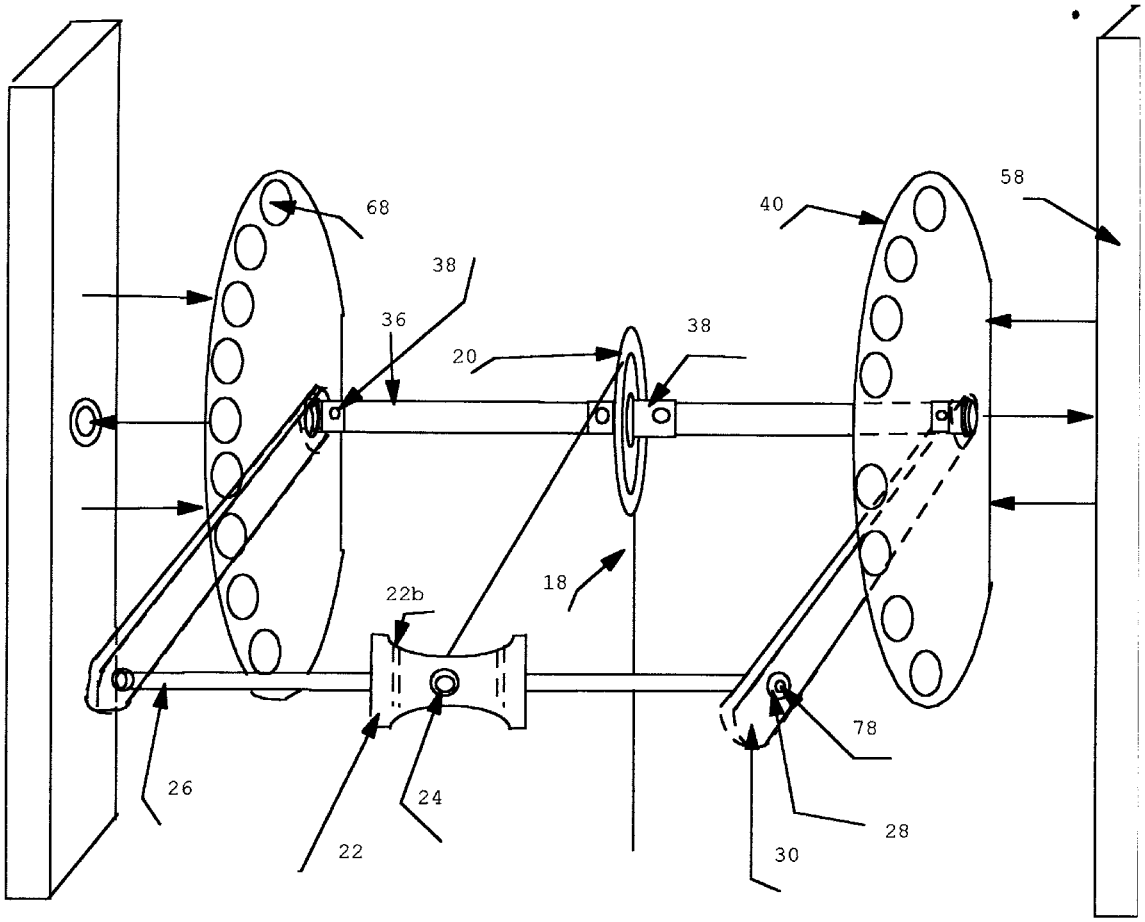
FIG. 6 is a view of how the pulley rod, pulley, adjustment arm, and radius plates are assembled and the radius plates are welded to the inner side of the left and right vertical frame.

In FIG. 1 there is shown a front view of a wrist and forearm exercising machine. It is comprised of a vertical, tubular steel frame 58 affixed to a bottom horizontal steel base 60 on the right side, and a vertical, tubular steel frame 58 affixed to a bottom horizontal steel base 60 on the left side. There is an upper, tubular steel transverse beam 44 that is affixed to and connects the upper two ends of the two vertical frames 58. There is an upper, plate steel gusset 56 welded to each end of the upper transverse beam 44 on the underside that will abut the inside of each vertical frame 58 in the ninety degree angle. There is a length of angle iron welded to each gusset 56 so that it fits around the inside back corners of each vertical frame 58. The upper transverse beam 44 is fastened to each of the two vertical frames 58 by means of two holes drilled through steel mounting plates 62, each vertical frame 58 and each length of angle iron welded to the upper gussets 56 by inserting bolts 74, secured by nuts. There is a lower horizontal tubular steel transverse beam 50 that is affixed to and connects the two bottom horizontal bases 60. There is a lower plate steel gusset 54 welded into each of the four ninety degree angles between each of the vertical frames 58 and each of the horizontal bases 60. The lower transverse beam 50 is affixed to each of the bottom bases 60 by drilling two holes through each of two lower steel mounting plates 64, each horizonal base 60 and ends of the lower transverse beams 50 inserting bolts 74 and securing with nuts. There are four rubber feet 66 that slip over and cover the four holes in the ends of the two bottom bases 60. There is one hole drilled through each of two plate steel radius plates 40 to the rear and center of each plate. There are nine adjustment holes 68 drilled through each radius plate 40 toward the front of the plate. Each radius plate 40 is welded to the inner surface of each vertical frame 58 with the rear hole on each plate being backed up by the inner surface of each vertical frame 58. This provides a mounting surface for a cold roll steel pulley rod 36 with a pulley 20 centered on the pulley rod 36 by a pulley spacer 38 affixed to the pulley rod 36 on both sides of the pulley 20 There are two adjustable plate steel arms 30 with holes drilled in one end the same size as the pulley rod 36. This will allow the arms 30 to slide over the ends of the pulley rod 36. The rear holes drilled in the radius plates 40 are the same size as the pulley rod 36, allowing the pulley rod 36 to be inserted in each of the rear holes in the radius plates 40 and stopped by the inner surface of each vertical frame 58. Each arm 30 has one adjustment hole 70 drilled through to correspond to the adjustment hole 68 in the radius plates 40. A removable adjustment pin 32 is inserted through each arm adjustment hole 70 into any corresponding adjustment hole 68 in the radius plate 40 to the desired height for exercise. On the opposing ends of each arm 30 there is a hole drilled to mount ball/needle bearings in a race 28. Inserted through the ball/needle bearings 28 is each end of a shouldered cold roll steel rotating rod 26. There is a core drilled out of a steel butterfly 22 that is inserted over and affixed to the center of the rotating rod 26 with roll pins 22*b* which are inserted in holes drilled through each side of the center of the butterfly 22. There is a shouldered hole drilled through the center of the butterfly 22 and the rotating rod 26 that allow for attachment of a countersunk cable 18 with a clip on the end to prevent pull through, with the hole on the attached side covered by a cable tension cap 24. There is a bearing retaining clip 76 slipped over each end of the rotating rod 26 and held against the inside surface of each arm 30 by the shoulders on each end of the rotating rod 26. Each end of the rotating rod 26 has a pre-drilled hole. A washer is placed over these holes on the outside of each arm 30 and bearing retaining bolt 78 is inserted through the washer and screwed into the holes in each end of the rotating rod 26 to hold the bearing 28 in place and secure the rotating rod 26 to the arms 30. There is a steel upper guide rod mounting plate 46 welded to the under surface of the upper transverse beam 44 in the center flush with the front side of the upper transverse beam 44. There is a steel lower guide rod mounting plate 48 welded to the top surface of the lower transverse beam 50 in the center flush with the front side of the lower transverse beam 50. Each of these two weight guide rod mounting plates 46 and 48 have two holes drilled through them parallel to and towards the back edge of each plate 46 and 48. Into the left side hole in plates 46 and 48 is inserted a shouldered, steel weight guide rod 34 that has holes drilled into each end. Into the right side hole in plates 46 and 48 is inserted a shouldered, steel weight guide rod 34 that has holes drilled into each end. The two guide rods 34 are then secured to the two plates 46 and 48 by screwing four guide rod mounting bolts 42 with washers affixed into the holes drilled in end of the two guide rods 34. The weight guide rods 34 extend through corresponding holes drilled through each plated weight 11 in the weight stack 10 that is resting on two rubber doughnuts 52 that are sitting on the lower guide rod mounting plate 48. The cable 18 is attached to the butterfly 22 rotating rod 26 combination and fed over the top of the pulley 20, down to and attached to the steel lift eye 14. The lift eye 14 is screwed into the top of the weight pin rod assembly 16. The weight pin rod 16 is secured to the top weight 11 by means of a roll pin 22B, centered just above the weight selector hole. There are three vertical holes drilled into each weight of the weight stack 10. One hole drilled in the center, for the weight pin rod 16 to pass freely through the weight stack 10 in a vertical movement as the desired amount of weight is chosen to work with. Two other holes are drilled in each weight 11 of the weight stack 10, one to the left of the center, and one to the right of the center. These two holes are for the guide rods 34. There are horizontal holes 72 drilled through each weight 11 of the weight stack 10 that correspond with the horizontal holes drilled through the pin rod assembly 16. This allows the insertion of the weight selector pin 12 into the selected pin rod hole 72 through the corresponding hole in the pin rod assembly 16. It should be noted, prior to assembly, the butterfly 22 should be affixed to the rotating rod 26, the pulley 20 should be affixed to the pulley rod 36 with the pulley rod spacers 38, the bearings 28 should be inserted into the adjustment arms 30, the adjustable arms 30 should be slipped over the ends of the pulley rod 36, the ends of the rotating rod 26 should be inserted through the bearings 28 with the bearing retaining clips 76 in place and the rotating rod 26 should be secured to the adjustable arms 30 with the bearing retaining bolts 78 and washers. You would then loosely attach the lower transverse beam 50 place the ends of the pulley rod 36 in the holes drilled in the radius plates 40 place the weight guide rods 34 in the lower holes, then put the upper transverse beam 44 in place.

Several inventions in the past have utilized the method of affixing a length of cable, string, or rope to a weight on one end, and an elongated cylindrical object on the other. Then by grasping the cylindrical object with the left hand, left of the center, and the right hand, right of the center, you would extend the arms out from the shoulders, and rotate the cylindrical object either in the forward or reverse direction, causing the cable, string, or rope to wrap around the cylindrical object, thereby; lifting the weight in a vertical direction and reversing the process to lower the weight. This exercises the muscles of the wrist and forearms, but places undue stress on other muscles, in particular; the muscles of the shoulders. There is no adjustment for height, except by raising or lowering the arms.

Other inventions utilizing this method allow them to be hooked over a door or attached to some other object, supported by the cable, string, or rope, and greatly limits the amount of weight that can be utilized. These inventions are portable and can be easily transported from one location to another by human means without assistance.

Still another invention uses the same principle with horizontally adjustable hand grips and a series of pulleys mounted on a frame. The rotating rod is mounted to the frame, but does not have a vertical height adjustment.

The purpose of this invention is to provide a frame mounted mechanism with a fully supported height adjustable rod, and individually selective weights, the total weight of which is limited only by the users strength and the tensile strength of the cable, which it does.

It should be noted that all the drawings and descriptions are to illustrate the principles of the invention. There are various changes that can be made to the various components of the invention without altering the principles or spirit of the invention or the scope of the claims.

PREFERRED METHOD OF OPERATION

The user would first take the weight selector pin 12 and insert it through the weight pin rod hole 72, in the selected weight, into the corresponding holes in the pin rod assembly 16. This would lock in the selected weight and all above it for exercise. The weights below the selected weight would remain in the resting position and not be included in the exercise.

The user would then grasp the rotating rod 26 with one hand to support it, then adjust the the arms to the desired height by moving the rotating rod 26 up or down. When the height is chosen, this would be done when the holes of the adjustment arms 30 correspond with the holes in the radius plates 40. The user would insert the adjustment pins 32 through the aligning holes on each side.

The user is now ready to exercise:

User would grasp the rotating rod 26 left of the center with the left hand, and right of the center with the right hand. User would rotate the rotating rod 26 in either the forward or reverse direction, causing the cable 18 to wrap around the rotating rod butterfly 22, thereby lifting the selected weight in a vertical direction. The process would be reversed to lower the selected weight to the resting position.

What I claim as my invention is:

1. An exercise machine for wrist and forearm development comprising:

a frame;

an arm having one end pivotally attached to the frame for rotation about a first axis;

a rod rotatably attached to the free end of the arm for rotation about its long axis;

a mechanism for fixing the arm in a selected angular position about the first axis, thus adjusting the height of the free end of the arm;

a pulley rotatably attached to the frame; and a cable having one end affixed to the rod, an intermediate portion passing over the pulley, and an opposite end operatively connected to a source of resistance;

whereby a user may exercise by winding the cable upon the rod, overcoming the resistance source.

2. The exercise machine of claim 1, wherein the source of resistance comprises weight resistance.

3. The exercise machine of claim 2, wherein the weight resistance comprises a stack of weights.

4. The exercise machine of claim 3, wherein the stack of weights is vertically guided by rods attached to the frame.

5. The exercise machine of claim 1, wherein the mechanism for fixing the arm in a selected angular position comprises a movable member engaging both the arm and the frame.

6. The exercise machine of claim 5, wherein movable member is a pin which engages aligned holes in the arm and frame.

7. The exercise machine of claim 6, wherein the pin engages one of a series of holes in the frame.

8. The exercise machine of claim 7, wherein the series of holes is spaced along a radius in a plate included in the frame.

9. The exercise machine of claim 1, wherein a butterfly is affixed to the rod and the one end of the cable is affixed to the butterfly.

10. The exercise machine of claim 1, wherein the arm and pulley rotate on a common axis.

11. An exercise machine for wrist and forearm development comprising:

a frame;

a pair of arms, each having one end pivotally attached to the frame for rotation about a common first axis;

a rod rotatably attached between the free ends of the arms for rotation about its long axis;

a mechanism for fixing the arms in a selected angular position about the first axis, thus adjusting the height of the free ends of the arms;

a pulley rotatably attached to the frame; and a cable having one end affixed to the rod, an intermediate portion passing over the pulley, and an opposite end operatively connected to a source of resistance;

whereby a user may exercise by winding the cable upon the rod, overcoming the resistance source.

12. The exercise machine of claim 11, wherein the source of resistance comprises weight resistance.

13. The exercise machine of claim 12, wherein the weight resistance comprises a stack of weights.

14. The exercise machine of claim 13, wherein the stack of weights is vertically guided by rods attached to the frame.

15. The exercise machine of claim 11, wherein the mechanism for fixing the arm in a selected angular position comprises a pin engaging aligned holes in one of the arms and the frame.

16. The exercise machine of claim 15, wherein the pin engages one of a series of holes in a plate included in the frame.

17. The exercise machine of claim 17, wherein the series of holes is spaced along a radius.

18. The exercise machine of claim 15, wherein a pair of pins engage respective pairs of aligned holes in the arms and frame.

19. The exercise machine of claim 11, wherein a butterfly is affixed to the rod and the one end of the cable is affixed to the butterfly.

20. The exercise machine of claim 11, wherein the arm and pulley rotate on a common axis.

* * * * *